US009410548B2

(12) United States Patent
Smith

(10) Patent No.: US 9,410,548 B2
(45) Date of Patent: Aug. 9, 2016

(54) PUMPING DEVICE

(76) Inventor: Andrew Smith, Rotherham (GB)

( * ) Notice: Subject to any disclaimer, the term of this patent is extended or adjusted under 35 U.S.C. 154(b) by 1052 days.

(21) Appl. No.: 13/490,670

(22) Filed: Jun. 7, 2012

(65) Prior Publication Data

US 2013/0142616 A1 Jun. 6, 2013

(30) Foreign Application Priority Data

Jun. 7, 2011 (GB) ..... 1109516.3

(51) Int. Cl.

| | |
|---|---|
| ***F01D 1/00*** | (2006.01) |
| ***F04D 1/00*** | (2006.01) |
| ***F04D 7/04*** | (2006.01) |
| ***F04D 29/22*** | (2006.01) |
| ***F04D 29/24*** | (2006.01) |

(52) U.S. Cl.

CPC *F04D 1/006* (2013.01); *F04D 7/04* (2013.01); *F04D 29/2216* (2013.01); *F04D 29/245* (2013.01)

(58) Field of Classification Search

CPC ..... F04D 1/006; F04D 11/00; F04D 11/005; F04D 29/22; F04D 29/2205; F04D 29/2211; F04D 29/2216; F04D 29/2222; F04D 29/2233; F04D 29/2238; F04D 29/225; F05D 2200/26; F05D 2200/261; F05D 2200/262

See application file for complete search history.

(56) References Cited

U.S. PATENT DOCUMENTS

| | | | | |
|---|---|---|---|---|
| 3,487,784 | A * | 1/1970 | Rafferty et al. | 415/119 |
| 3,902,823 | A * | 9/1975 | Minato et al. | 416/186 R |
| 6,220,832 | B1 * | 4/2001 | Schob | 417/423.5 |
| 2010/0021337 | A1 * | 1/2010 | Kim et al. | 420/62 |

FOREIGN PATENT DOCUMENTS

| | | |
|---|---|---|
| JP | 59217495 | 12/1984 |
| JP | 60133293 | 7/1985 |
| JP | 6307375 | 11/1994 |
| RU | 294643 | 4/1971 |

* cited by examiner

*Primary Examiner* — Craig Kim
*Assistant Examiner* — Michael Sehn
(74) *Attorney, Agent, or Firm* — King & Schickli, PLLC

(57) ABSTRACT

A pump is disclosed, with a casing comprising a substantially circular body having at least two radial inlets, at least one peripheral outlet and a transversal aperture. The casing further comprises a substantially circular impeller mounted within the body for rotation about the aperture. The impeller has a substantially uninterrupted sinusoidal profile. A pumping system and a method of pumping are also disclosed, which use the pump configuration.

23 Claims, 5 Drawing Sheets

PUMPING DEVICE

FIELD OF THE INVENTION

The present invention relates to centrifugal pumping devices. More particularly, the present invention relates to mixed flow pumps.

BACKGROUND OF THE INVENTION

Centrifugal pumping devices are rotodynamic pumping devices which use a rotating impeller within a casing for increasing the pressure and flow rate of a fluid within a fluid conveying network. In centrifugal pumps, a fluid is fed, from an upstream piping system, into the pump casing along or near to the rotating axis of the impeller and is accelerated by the impeller, flowing radially or axially outward into a diffuser or volute chamber, which the fluid exits into a downstream piping system. Rotodynamic pumping devices are typically used for large discharge through smaller heads, and several different types of centrifugal pumps are known, which include radial flow pumps, axial flow pumps and mixed flow pumps.

Mixed flow pumps combine the characteristics of radial and axial flow pumps, wherein the fluid is fed, from an upstream piping system, into the pump casing in which it is radially accelerated and lifted and which it exits at an angle, typically of 0 to 90 degrees relative to the axial direction. Mixed flow pumps operate at higher pressures than axial flow pumps, yet output higher discharges than radial flow pumps.

Several different types of impellers are known for use with rotodynamic pumping devices. Open impellers comprise a series of vanes attached to a central hub for mounting on a shaft, without any form of sidewall or shroud. Semi-open impellers incorporate a single shroud at the back of the impeller. Closed impellers incorporate a shroud on either side of the vanes. The type of impeller varies in accordance with the intended use, the pump characteristics, or a combination of both, and may influence the casing design. For instance, a casing for use with radial flow impellers is typically concentric with the impeller, as opposed to the volute-type casings.

Impellers used in centrifugal pumps may be further classified as single-suction or double-suction impellers, depending on the configuration in which liquid enters the eye of the impeller. A single-suction impeller allows liquid to enter the impeller eye from one side only, whereas a double-suction impeller allows liquid to enter the impeller eye from both sides. The double-suction arrangement has the advantage of balancing the end thrust in both respective directions. However, small capacity centrifugal pumps are usually of a single-suction design, which imposes an unbalanced thrust of the shaft thrust bearing that has to be taken into account, as well as unbalanced forces on the pump which may cause vibrations.

An improved design is required for a centrifugal pump with a double-suction impeller, having an easily scalable capacity and which is economical to manufacture.

SUMMARY OF THE INVENTION

According to a first aspect of the present invention, there is provided a casing for a pump comprising a circular body having at least two radial inlets, at least one peripheral outlet and at least one transversal aperture, a substantially circular impeller mounted within the body for rotation about the aperture, wherein the impeller has a substantially sinusoidal profile.

This casing and the sinusoidal impeller within advantageously maintain a stable flow output of a mix of at least two fluids fed into the body via the radial inlets.

The main axis of the peripheral outlet is preferably offset relative to the diameter of the body. The main axis of the peripheral outlet is preferably not tangential relative to the body periphery, i.e. the peripheral outlet preferably exits the body at an angle relative to the radial direction.

The body preferably comprises two opposed sides, wherein each radial inlet is located on a respective side of the pump body. In this configuration, the impeller is advantageously a double-suction impeller, wherein one or more fluids enter the impeller eye from both sides.

In a preferred embodiment, at least two peripheral outlets are transversally aligned with one another. In an alternative embodiment, at least two peripheral outlets are transversally offset relative to one another. The positioning of the at least two peripheral outlets may depend upon the fluid properties, casing size and impeller speeds, among other considerations.

The body is preferably made of a substantially non-resilient material. More preferably, the body is made of a substantially metallic material impervious to corrosion. More preferably still, the body is made of a chromium-titanium alloy. The choice of material for the body may depend upon the fluid properties, casing size and impeller speeds, among other considerations.

The body preferably comprises two sections releasably attached to one another. In a preferred embodiment, the transversal aperture is central relative to the body, each of the two sections is substantially frusto-conical about the aperture and has a peripheral wall substantially parallel to a main axis of the aperture. In this configuration, the two sections effectively define a substantially toroidal chamber when attached to one another.

The impeller shaft is supported on both sides between the two sections by a bearing, which is located within a groove in the external wall of each of the frusto-conial sections about the aperture. This configuration reduces vibrations of the shaft and the impeller and maintains the equilibrium of the impeller, resulting is increased efficiency and quieter operation.

The shape of the wall of each frusto-conical section corresponds closely to the rotating profile of the sinusoidal impeller. This configuration reduces turbulence and interferences within currents in the fluids, that may result from the movement of the impeller. This configuration also maximises power transfer from the rotating impeller to the fluids. The impeller is designed to occupy as little volume as possible, whilst still providing a high power-to-size ratio.

The impeller is preferably made of a substantially non-resilient material. More preferably, the impeller is made of a substantially metallic material impervious to corrosion. More preferably still, the impeller is made of a chromium-titanium alloy. The choice of material for the impeller may depend upon the fluid properties, casing size and impeller speeds, among other considerations.

Preferably, the impeller is continuously sinusoidal about its periphery. The amplitude of the sinusoid is substantially greatest at the periphery of the impeller and substantially minimal to non-existent nearest the eye of the impeller, uniformly about the impeller. That is, the amplitude of the sinusoid decreases in a radial direction, towards the eye of the impeller, uniformly about the impeller.

The angular frequency of the sinusoid defines the number of vanes of the impeller, on both sides of the impeller. The sinusoid is preferably a sine curve. Alternatively, the sinusoid may be a stepped sine curve, wherein a plurality of square steps combines to define substantially a sine over a cycle of the curve. The choice of sinusoid type for the impeller may depend upon the fluid properties, casing size and impeller speeds, among other considerations.

According to a second aspect of the present invention, there is provided a pump comprising a casing substantially as described above, a shaft engaging the impeller through the aperture, and means to power the shaft.

According to a third aspect of the present invention, there is provided a pumping system comprising at least two casings substantially as described above, a shaft for engaging the respective impellers of the at least two casings, and means to power the shaft, wherein the casings are disposed substantially adjacent one another and their respective impellers are co-axially mounted on the shaft.

According to a fourth aspect of the present invention, there is provided a method of pumping at least two fluids, comprising the steps of disposing at least two casings as described above substantially adjacent to and co-axially with one another, engaging the respective impellers of the at least two casings with a shaft, rotating the shaft with shaft powering means, feeding at least a first fluid in the first radial inlet of each casing, and feeding at least a second fluid in the second radial inlet of each casing.

Other aspects are as set out in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Figure 1:
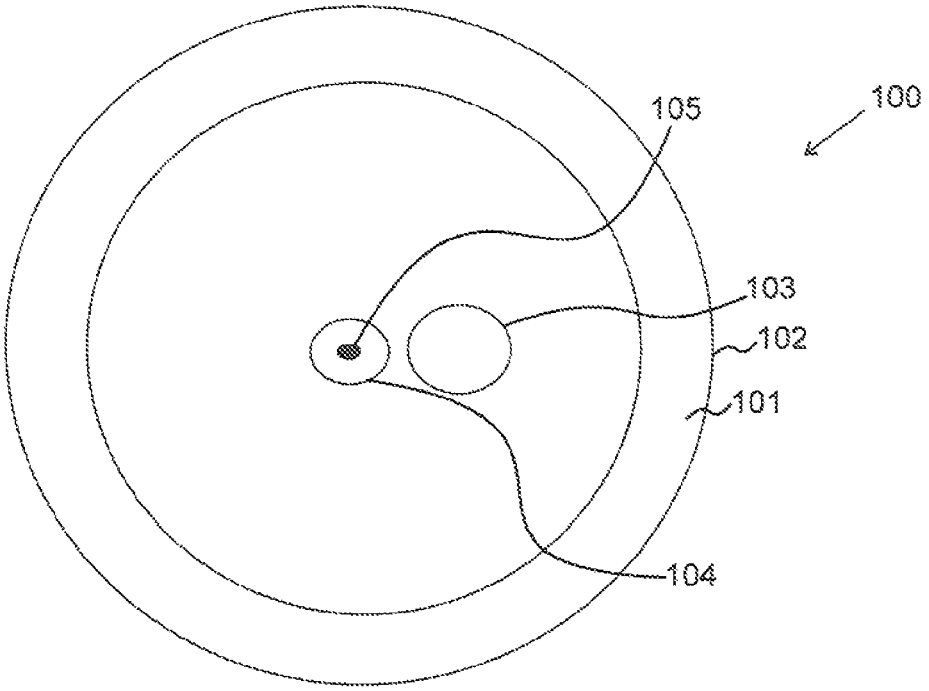
FIG. 1 is a top view of a first side of a casing for a pump according to a first embodiment of the present invention.

With reference to FIG. 1, there is shown a top view of a first side 101 of a casing 100 for a pump according to a first embodiment of the present invention. The casing 100 comprises a substantially circular body 102 having a first radial inlet 103 therein, which is located proximate a transversal aperture 104. The aperture 104 is co-axial with the geometrical centre 105 of the body 102 and extends through both sides of the casing 100.

Figure 2:
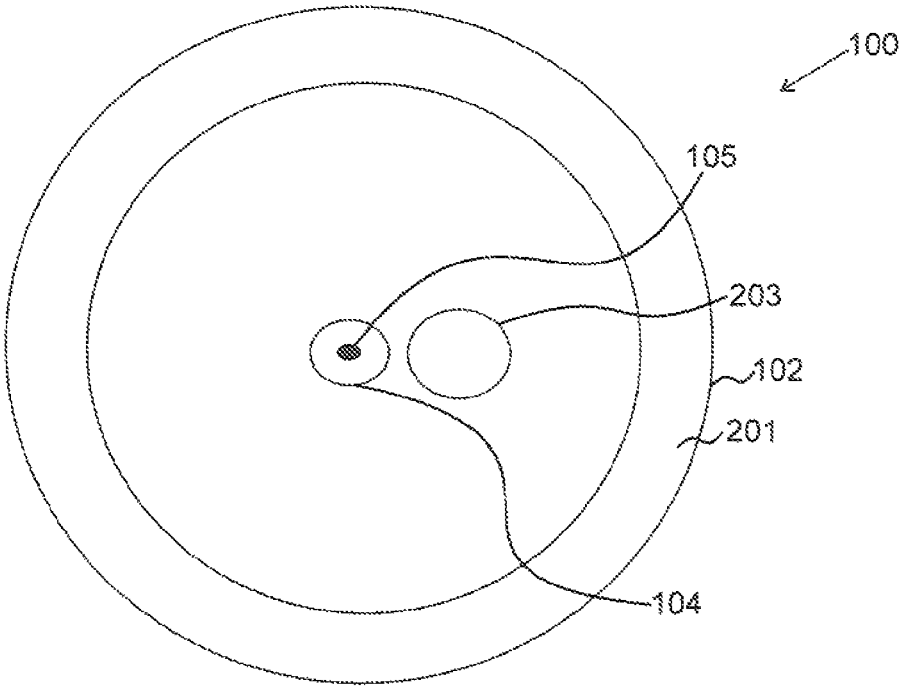
FIG. 2 is a top view of the second side of the casing of FIG. 1.

With reference to FIG. 2, there is shown a top view of the second side 201 of the casing 100, opposed to the first side 101. The substantially circular body 102 has a second radial inlet 203 therein, which is also located proximate the transversal aperture 104. In this embodiment, the first and second radial inlets 103, 203 are transversally aligned with one another.

Figure 3:
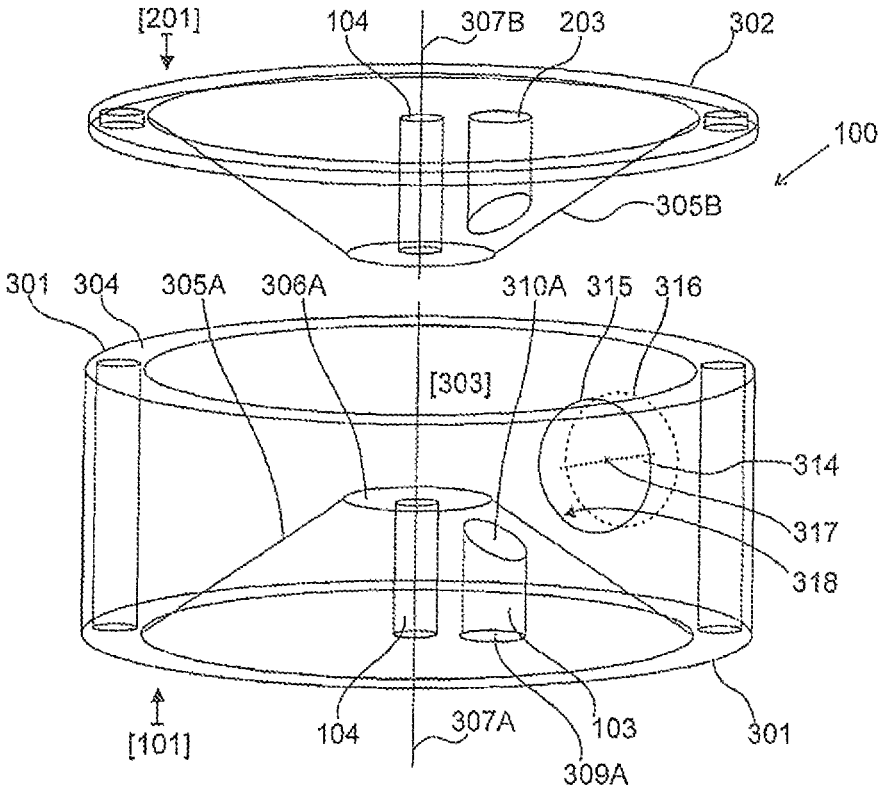
FIG. 3 is a lateral exploded view of the casing of FIGS. 1 and 2.
Figure 4:
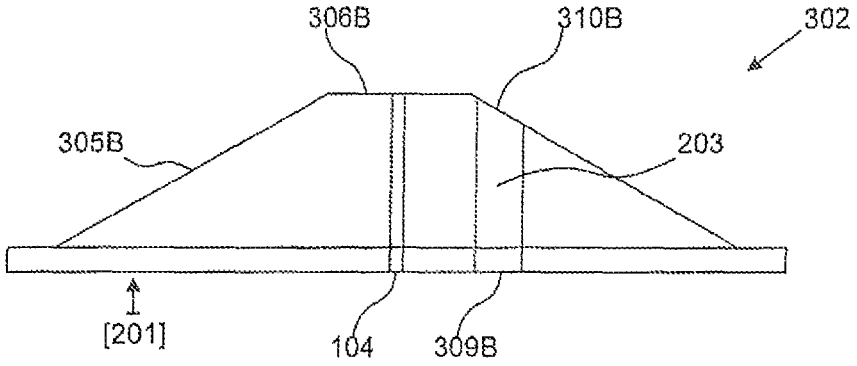
FIG. 4 is a lateral view of a section of the casing of FIGS. 1 to 3.

With reference to FIGS. 3 and 4, the body 102 comprises two sections 301, 302 releasably attached to one another with suitable fastening means. Each section 301, 302 is substantially circular and of a same overall diameter. At least the first section 301 has a substantially cylindrical outer shape with an open end, which the second section 302 closes in use when the sections are secured to one another. The casing 100 is therefore substantially cylindrical itself.

In a preferred embodiment, nuts and bolts are used for releasably attaching the sections to one another. Through apertures are located about the periphery of the first section 301 within its cylindrical wall and corresponding through apertures about the periphery of the substantially disc-like second section 302. In use, the second section 302 is centered relative to, and located against, the first section 301, and bolts are threaded through their respective apertures aligned with one another, then releasably secured by threading nuts thereon.

The two sections 301, 302 are adapted to define a substantially toroidal chamber 303 within the body 102 when secured to one another, wherein the chamber 303 is bounded by the respective inner configurations of the two sections 301, 302 and a peripheral wall 304 extending from the first section 301 between the two sides 101, 201, parallel to the main transversal axis of the body 102.

The first section 301 comprises the peripheral wall 304 extending away from the first side 101 and a frusto-cone 305A having at least a portion of the first body side 101 as its base, having a height equal to substantially half the width of the body 102 minus half the width of the impeller, and having a uniformly decreasing diameter between its base and its truncated extremity 306A. The main transversal axis 307A of the frusto-cone 305A is co-axial with the main transversal axis of the body 102 and parallel to the peripheral wall 304, thus the aperture 104 extends centrally through the first section 301 and the frusto-cone 305A.

The wall of the aperture 104 adjacent the truncated extremity 306A comprises a groove (not shown) suitable for accommodating a bearing which supports the impeller shaft on a first side.

In this embodiment, the base of the frusto-cone 305A is substantially the entire diameter of the first body side 101, minus the width of the peripheral wall 304. A first portion of the chamber 303 is therefore defined by the tapered wall of the frusto-cone 305A and the peripheral wall 304 of the body 102. In alternative embodiments, the first portion of the chamber 303 may be further defined by a substantially planar inner wall of the first section 301 extending between the frusto-cone 305A and the peripheral wall 304.

The first section 301 further comprises the first inlet 103, which is a through aperture extending between the first side 101 and the tapered wall of the frusto-cone 305A. A first extremity 309A of the first inlet 103 is located adjacent the aperture 104 on the first side 101 and the second extremity 310A of the first inlet 103 is located adjacent the truncated extremity 306A of the frusto-cone 305A. The through aperture 309A, 310A is substantially rectilinear and parallel to the main transversal axes of the body 102 and the frusto-cone 305A, therefore substantially parallel to the central aperture 104.

The second section 302 comprises a frusto-cone 305B having at least a portion of the second body side 201 as its base, having a height equal to substantially half the width of the body 102 minus half the width of the impeller, and having a uniformly decreasing diameter between its base and its truncated extremity 306B. The main transversal axis 307B of the frusto-cone 305B is also co-axial with the main transversal axis of the body 102 and parallel to the peripheral wall 304 of the first section 301, thus the aperture 104 extends centrally through the second section 302 and the frusto-cone 305B.

The wall of the aperture 104 adjacent the truncated extremity 306B also comprises a groove (not shown) suitable for accommodating a bearing which supports the impeller shaft on a second side.

In this embodiment, the base of the frusto-cone 305B is substantially the entire diameter of the second body side 201, minus the width of the peripheral wall 304. A second portion of the chamber 303 is therefore defined by the tapered wall of the frusto-cone 305B and the portion of peripheral wall 304 of the first section 301 which projects beyond the truncated extremity 306A of its frusto-cone 305A. In alternative embodiments, the second portion of the chamber 303 may be further defined by a substantially planar inner wall of the second section 302 extending between the frusto-cone 305B and the same portion of peripheral wall 304.

The second section 302 further comprises the second inlet 203, which is a through aperture extending between the second side 201 and the tapered wall of the frusto-cone 305B. A first extremity 309B of the second inlet 203 is located adjacent the aperture 104 on the second side 201 and the second extremity 3108 of the second inlet 203 is located adjacent the truncated extremity 306B of the frusto-cone 305B. The through aperture 309B, 310B is substantially rectilinear and parallel to the main transversal axes of the body 102 and the frusto-cone 305B, therefore substantially parallel to the central aperture 104.

The peripheral wall 304 of the first section 301 comprises a peripheral outlet 314, having a first extremity 315 substantially co-planar with the inner surface of the peripheral wall 304 and opening onto the chamber 303 and a second extremity 316 substantially co-planar with the outer surface of the peripheral wall 304 and opening to the outside of the casing 100. The peripheral outlet 314 is substantially rectilinear between its two extremities 315, 316. The peripheral outlet 314 has a main axis 317, which is not tangential with the outer surface of the peripheral wall 304, however at least a portion 318 of the surface of the peripheral outlet 314 is tangential with the inner surface of the peripheral wall 304. The peripheral outlet 314 is therefore offset relative to the diameter of the body 102.

Figure 5:
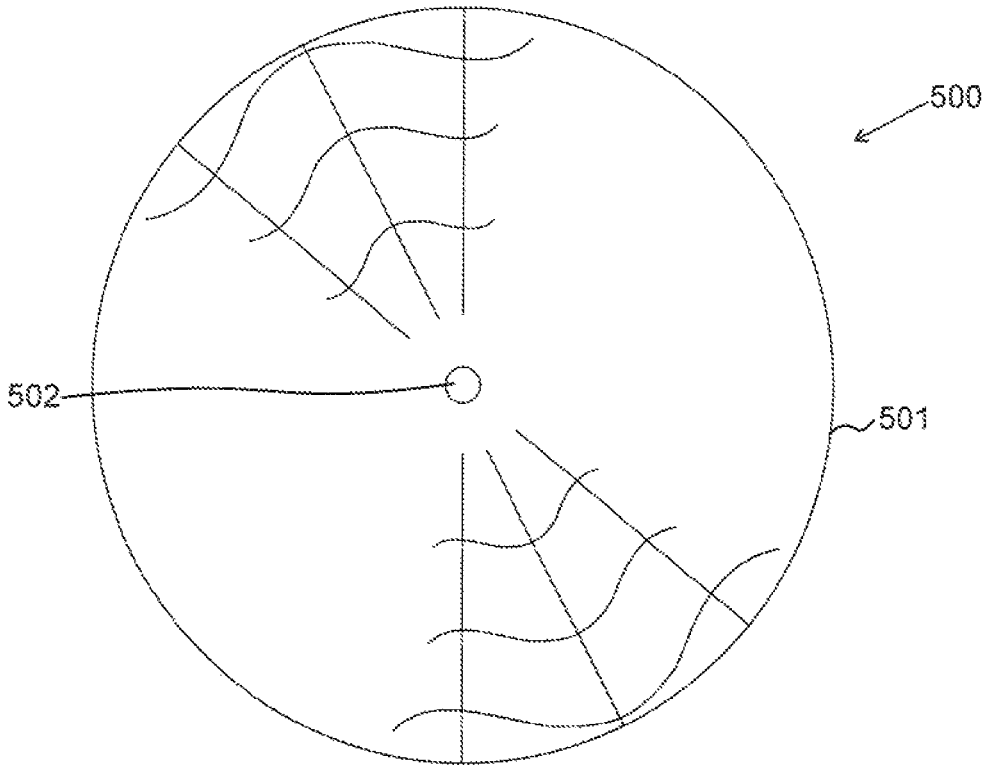
FIG. 5 is a top view of an impeller for use in the casing of FIGS. 1 to 4 according to a first embodiment of the present invention.
Figure 6:
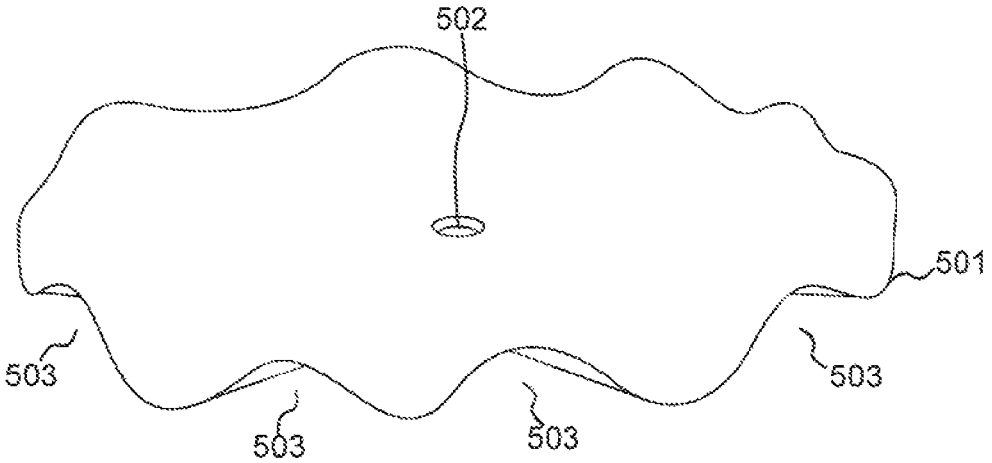
FIG. 6 is a lateral view of the impeller of FIG. 5.

With reference to FIGS. 5 and 6, an impeller 500 for use in the casing 100 is shown as a substantially circular, disc-like member, having a substantially sinusoidal periphery 501. The amplitude of the sinusoid increases uniformly across the member in a radial direction, between the geometrical center 502 or impeller eye, which is substantially planar, and the sinusoidal periphery 501, such that a plurality of radial volutes 503 are formed adjacent to one another about the member, each having an increasing dimension and volume towards the periphery 501.

The increase in amplitude between the geometrical center 502 and the sinusoidal periphery 501 corresponds substantially to the acute angle between the frusto-cones 305A, 305B when the first and sections 301, 302 are secured to one another, so that volutes 503 of the impeller 500 occupy substantially the transversal height and radial length of the chamber 303.

The shape of the wall of each frusto-conical section 305A, 305B corresponds closely to the rotating profile of the sinusoidal impeller 500. This configuration reduces turbulence and interference within currents in the fluids in the chamber 303, that may result from the rotation of the impeller 500. This configuration also maximises power transfer from the rotating impeller 500 to the fluids. The impeller 500 is designed to occupy as little volume as possible, whilst still providing a high power-to-size ratio.

Figure 7:
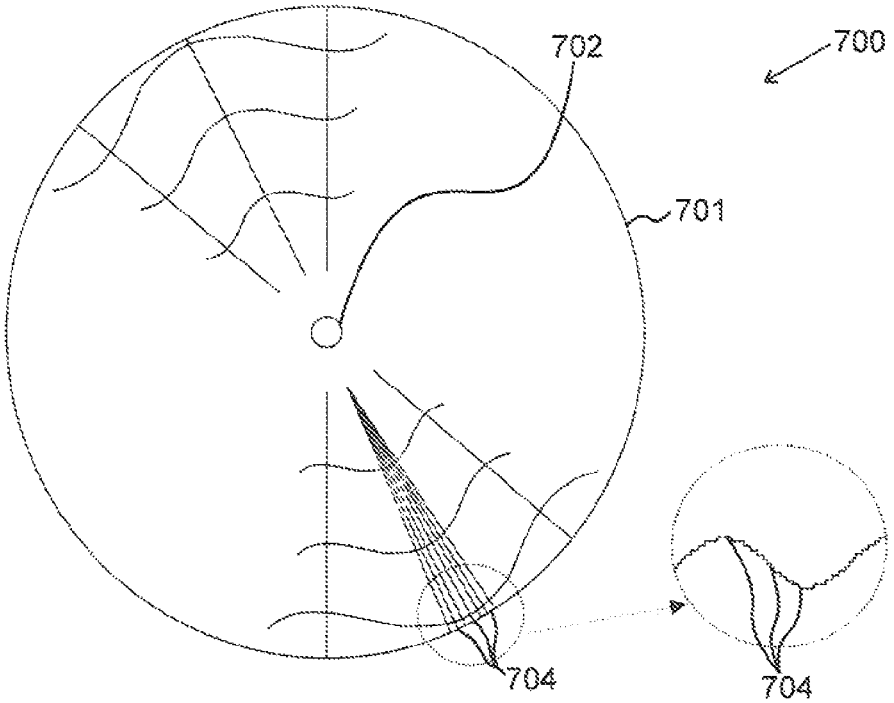
FIG. 7 is a top view of an impeller for use in the casing of FIGS. 1 to 4 according to a second embodiment of the present invention.
Figure 8:
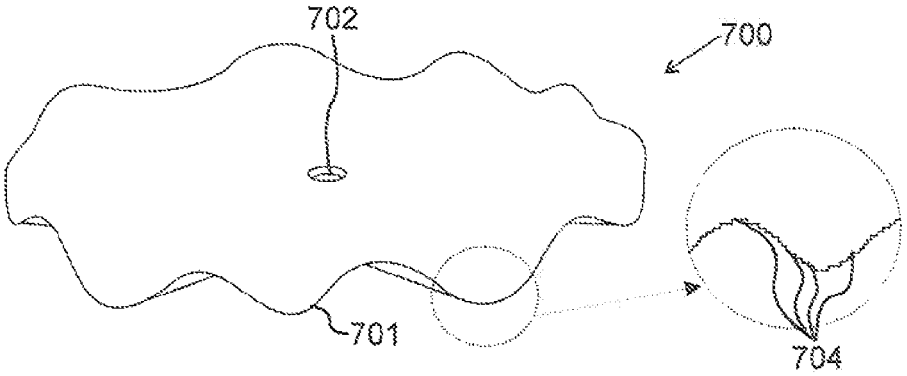
FIG. 8 is a lateral view of the impeller of FIG. 7.

With reference to FIGS. 7 and 8, an alternative impeller 700 for use in the casing 100 is shown as a substantially circular, disc-like member, having a substantially sinusoidal periphery 701. The amplitude of the sinusoid increases uniformly in discrete steps 704 across the member in a radial direction, between the geometrical center 702 or impeller eye, which is substantially planar, and the sinusoidal periphery 701, such that a plurality of radial stepped volutes 704 are formed adjacent to one another about the member, each having an increasing dimension and volume towards the periphery 701.

The increase in amplitude between the geometrical center 702 and the sinusoidal periphery 701 corresponds substantially to the acute angle between the frusto-cones 305A, 305B when the first and sections 301, 302 are secured to one another, so that stepped volutes 704 of the impeller 700 occupy substantially the transversal height and radial length of the chamber 303.

Figure 9:
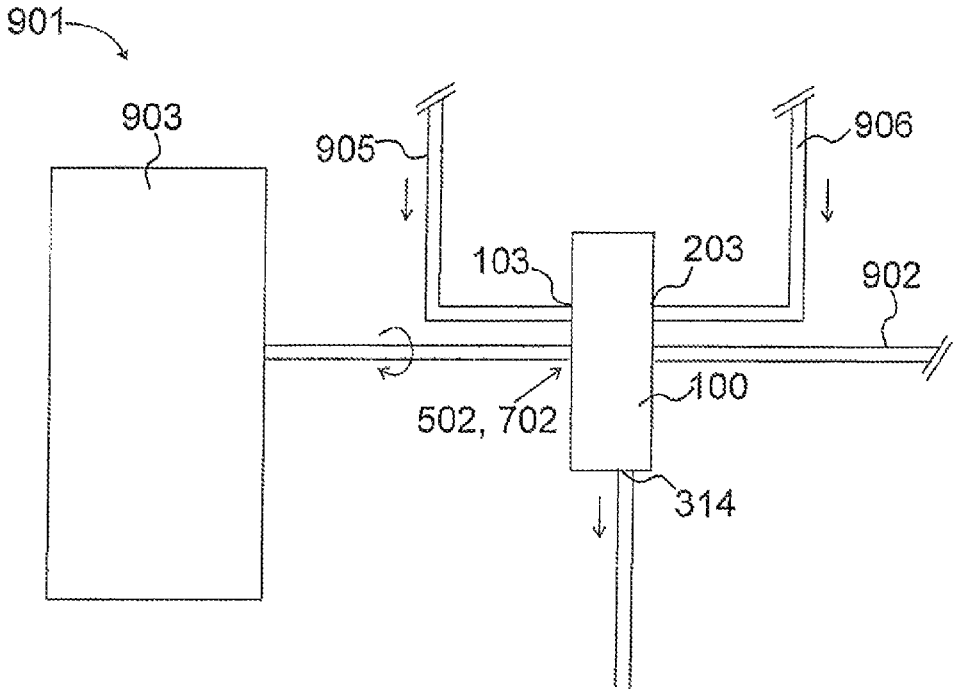
FIG. 9 is a lateral view of a pump having the casing of FIGS. 1 to 4 configured with the sinusoidal impeller of any of FIGS. 5 to 8.

With reference to FIG. 9, a pump 901 is shown wherein the impeller 500, 700 within a casing 100 is mated to a rotary shaft 902 driven by a power source 903, for instance an electric or hydraulic engine. A first fluid enters the casing 100 on its first side 101 via suitable upstream piping 905 connected to the first inlet 103, adjacent the impeller eye 502, 702. A second fluid enters the casing 101 on its second side 201 via suitable upstream piping 906 connected to the second inlet 203, adjacent the impeller eye 502, 702 and on its opposite side. Within the casing 100, specifically the chamber 303, the impeller 500, 700 is rotated by the shaft 902 whereby the fluids are channeled and driven by the volutes 503, 704 and mixed substantially peripherally. The mixed fluids exit the chamber 303 via the peripheral outlet 314 at a substantially constant flow rate. This pump advantageously provides a simple and economical double-suction impeller solution for relevant applications, which have hitherto considered double-suction impeller solutions impractical or uneconomical.

Figure 10:
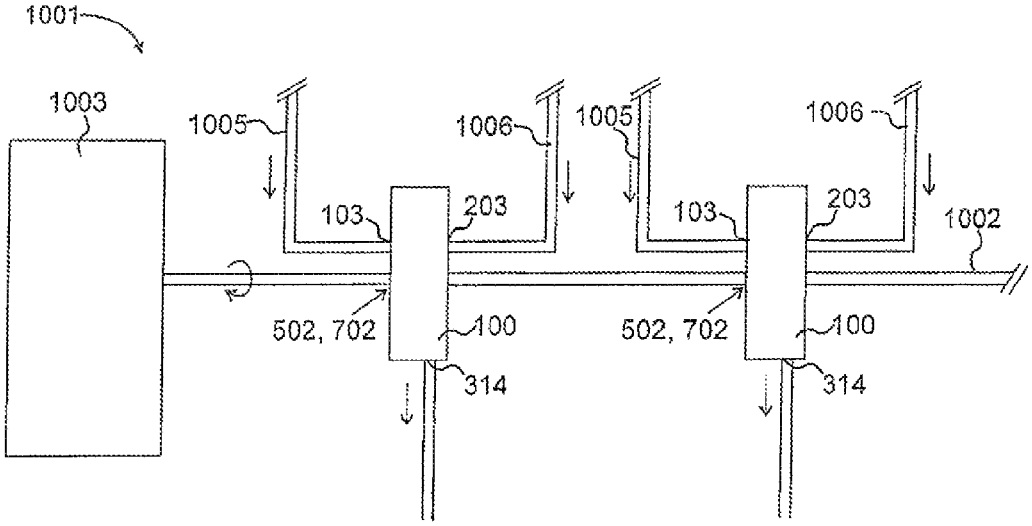
FIG. 10 is a lateral view of a pumping system having a plurality of casings of FIGS. 1 to 4, each configured with the sinusoidal impeller of any of FIGS. 5 to 8.

With reference to FIG. 10, a pumping system 1001 is shown wherein a plurality of impellers 500, 700 each within a respective casing 100, are mated to a same rotary shaft 1002 driven by a power source 1003, for instance an electric or hydraulic engine. A first fluid enters each casing 100 on its first side 101 via suitable upstream piping 1005 connected to the first inlet 103, adjacent the impeller eye 502, 702. A second fluid enters each casing 100 on its second side 201 via suitable upstream piping 1006 connected to the second inlet 203, adjacent the impeller eye 502, 702 and on its opposite side. Within each casing 100, specifically each chamber 303, the impeller 500, 700 is rotated by the shaft 1002 whereby the fluids are channeled and driven by the volutes 503, 704 and mixed substantially peripherally. The mixed fluids exit each chamber 303 via its peripheral outlet 314 at a substantially constant flow rate. This system advantageously reduces the power and drive train requirements for applications which require several pumps.

Various aspects of the casing, impellers, pumps, pumping system and methods of installation and/or use of the present invention have been described. It will be appreciated that other embodiments of the invention which fall within the overall scope and spirit of the invention, but which differ in various detailed aspects, are conceivable. Improvements and modifications may therefore be incorporated herein without deviating from the scope of the invention.

The words "comprises", "comprising", "having" and "including" when used herein with reference to the present invention are used to specify the presence of stated features, integers, steps or components but does not preclude the presence or addition of one or more other features, integers, steps, components or groups thereof.

The invention is not limited to the embodiments hereinbefore described but may be varied in both construction and detail.

The invention claimed is:

1. A casing for a pump comprising:

a circular body having at least one central aperture, at least two radial inlets, and at least one peripheral outlet, the body comprising two sections defining a volume apt to accommodate a substantially circular impeller with a substantially sinusoidal profile mounted within the body for rotation about the aperture wherein a wall of each section is substantially frusto-conical about the aperture and tapers inwardly as the wall extends from adjacent a periphery of the body into the volume.

2. The casing according to claim 1, wherein a main axis of the peripheral outlet is offset relative to the diameter of the body.

3. The casing according to claim 2, wherein the main axis of the peripheral outlet is not tangential relative to the body periphery.

4. The casing according to claim 1, wherein the body comprises two opposed sides and wherein each inlet is located on a respective side of the pump body.

5. The casing according to claim 4, wherein the at least two peripheral outlets are transversally aligned with one another.

6. The casing according to claim 4, wherein the at least two peripheral outlets are transversally offset relative to one another.

7. The casing according to claim 1, wherein the body is made of a substantially non-resilient material.

8. The casing according to claim 7, wherein the body is made of a substantially metallic material, which is impervious to corrosion.

9. The casing according to claim 8, wherein the body is made of is made of a chromium-titanium alloy.

10. The casing according to claim 1, wherein the two sections are releasably attached to one another.

11. The casing according to claim 10, wherein the central aperture is central relative to the body, and each section further comprises a peripheral wall substantially parallel to a main axis of the aperture.

12. The casing according to claim 11, wherein the two sections define a substantially toroidal chamber when attached to one another.

13. An impeller for use in the casing according to claim 1, wherein the impeller is made of a substantially non-resilient material.

14. The impeller according to claim 13, wherein the impeller is made of a substantially metallic material, which is impervious to corrosion.

15. The impeller according to claim 14, wherein the impeller is made of a chromium-titanium alloy.

16. The impeller according to claim 13, wherein the impeller is continuously sinusoidal about its periphery.

17. The impeller according to claim 16, wherein the amplitude of the sinusoid is substantially greatest at the periphery of the impeller and substantially minimal to non-existent nearest the eye of the impeller, uniformly about the impeller.

18. The impeller according to claim 16, wherein the angular frequency of the sinusoid defines the number of vanes of the impeller, on both sides of the impeller.

19. The impeller according to claim 16, wherein the sinusoid is a stepped sine curve.

20. A pump comprising a casing according to claim 1, an impeller made of a substantially non-resilient material, a shaft for engaging the impeller through the aperture, and means to power the shaft.

21. A pumping system comprising at least two casings according to claim 1, respective impellers made of a substantially non-resilient material, a shaft for engaging the respective impellers of the at least two casings, and means to power the shaft, wherein the casings are disposed substantially adjacent one another and their respective impellers are co-axially mounted on the shaft.

22. A method of pumping at least two fluids, comprising the steps of:

disposing at least two casings according to claim 1 substantially adjacent to and co-axially with one another, engaging respective impellers made of a substantially non-resilient material of the at least two casings with a shaft, rotating the shaft with shaft powering means, feeding at least a first fluid in the first radial inlet of each casing, and feeding at least a second fluid in the second radial inlet of each casing.

23. A pump comprising a casing according to claim 1, an impeller made of a substantially non-resilient material, a shaft for engaging the impeller through the aperture, and an electric or hydraulic engine to power the shaft.

* * * * *